US010280576B1

(12) United States Patent
Osorio

(10) Patent No.: US 10,280,576 B1
(45) Date of Patent: May 7, 2019

(54) MOBILE SNOW REMOVAL AND COLLECTION APPARATUS

(71) Applicant: Omar Osorio, Brampton (CA)

(72) Inventor: Omar Osorio, Brampton (CA)

( * ) Notice: Subject to any disclaimer, the term of this patent is extended or adjusted under 35 U.S.C. 154(b) by 0 days.

(21) Appl. No.: 15/702,714

(22) Filed: Sep. 12, 2017

(51) Int. Cl.
*E01H 5/10* (2006.01)

(52) U.S. Cl.
CPC ..... *E01H 5/102* (2013.01); *E01H 5/106* (2013.01)

(58) Field of Classification Search
CPC ..... E01H 5/102; E01H 5/104; E01H 5/10; E01H 5/106
USPC ..... 37/227–229
See application file for complete search history.

(56) References Cited

U.S. PATENT DOCUMENTS 980,993 A * 1/1911 Meindl ..... B29C 73/10 126/271.2 C
1,468,977 A * 9/1923 Schiesari ..... E01H 5/108 37/195
1,742,968 A * 1/1930 Polak ..... 126/343.5 R
3,066,428 A * 12/1962 Raiti ..... E01H 5/104 126/343.5 R
3,447,188 A * 6/1969 Maasberg ..... E01H 1/103 15/320
3,619,918 A * 11/1971 Morin ..... E01H 5/104 126/343.5 R
3,766,586 A * 10/1973 Krickovich ..... E01H 1/0845 15/340.3
4,071,966 A * 2/1978 Cohen ..... E01H 5/098 193/31 A
4,164,820 A 8/1979 Krickovich
4,226,034 A 10/1980 Benjamin et al.
5,561,921 A * 10/1996 Vanderlinden ..... E01H 1/001 15/78
5,630,286 A * 5/1997 Vanderlinden ..... E01H 1/001 15/322
6,845,570 B2 * 1/2005 Paterson ..... E01H 1/108 34/226
8,365,346 B2 * 2/2013 Coppola ..... E01H 1/108 15/320
2004/0074114 A1 * 4/2004 Rogers ..... E01H 5/104 37/228
2016/0053452 A1 * 2/2016 Treglown ..... E01H 5/104 37/228
2016/0356010 A1 * 12/2016 Wilkinson ..... E01H 5/104
2017/0152639 A1 * 6/2017 Cho ..... E01H 5/104

* cited by examiner

*Primary Examiner* — Thomas B Will
*Assistant Examiner* — Joan D Misa

(57) ABSTRACT

A mobile snow removal and collection apparatus including a wheeled motorized vehicle having a front cab and a vehicle chassis attached to a back end of the front cab. A snow removal collection tank is disposed atop the vehicle chassis. A heating unit is disposed atop the vehicle chassis, and a vacuum unit is disposed atop the heating unit. Each of a drainage hose and a snow intake hose is extended outward from and in fluid communication with the inner chamber of the snow removal collection tank. The vacuum unit is configured to pull snow into the inner chamber of the snow removal collection tank through the snow intake hose, and the heating unit is configured to melt the snow disposed within the snow removal collection tank.

1 Claim, 4 Drawing Sheets

MOBILE SNOW REMOVAL AND COLLECTION APPARATUS

BACKGROUND OF THE INVENTION

Various types of snow removal apparatuses are known in the prior art. However, what has been needed is a mobile snow removal and collection apparatus including a wheeled motorized vehicle having a front cab and a vehicle chassis attached to a back end of the front cab. What has been further needed is a snow removal collection tank disposed atop the vehicle chassis, a heating unit disposed atop the vehicle chassis, and a vacuum unit disposed atop the heating unit. Lastly, what has been needed is for each of a drainage hose and a snow intake hose to be extended outward from and in fluid communication with the inner chamber of the snow removal collection tank, such that the vacuum unit is configured to pull snow into the inner chamber of the snow removal collection tank through the snow intake hose. The heating unit is further configured to melt the snow disposed within the snow removal collection tank. The mobile snow removal and collection apparatus thus provides a uniquely structured snow removal mechanism that eliminates the need for valuable parking spaces, access to sidewalks, and driveways to be filled with snow that has been shoveled or plowed from roads and sidewalks. Additionally, the apparatus effectively eliminates all residual snow buildup so that ice does not form with the remainder of snow left over through traditional snow removal methods.

FIELD OF THE INVENTION

The present invention relates to snow removal apparatuses, and more particularly, to a mobile snow removal and collection apparatus.

SUMMARY OF THE INVENTION

The general purpose of the present mobile snow removal and collection apparatus, described subsequently in greater detail, is to provide a mobile snow removal and collection apparatus which has many novel features that result in a mobile snow removal and collection apparatus that is not anticipated, rendered obvious, suggested, or even implied by prior art, either alone or in combination thereof.

To accomplish this, the present mobile snow removal and collection apparatus includes a wheeled motorized vehicle having a front cab and a vehicle chassis attached to a back end of the front cab. A snow removal collection tank is disposed immediately atop the vehicle chassis of the wheeled motorized vehicle, with the snow removal collection tank having an inner chamber. A heating unit is disposed atop the vehicle chassis between the back end of the front cab of the wheeled motorized vehicle and the snow removal collection tank. The heating unit has a motorized fan, at least one heating element, an intake vent in fluid communication with the motorized fan, and a heating nozzle in fluid communication with each of the motorized fan and the inner chamber of the snow removal collection tank. A vacuum unit is disposed atop the heating unit and between the back end of the front cab of the wheeled motorized vehicle and the snow removal collection tank. The vacuum unit has a motorized blower, an exhaust vent in fluid communication with the motorized blower, and a vacuum nozzle in fluid communication with each of the motorized blower and the inner chamber of the snow removal collection tank.

The mobile snow removal and collection apparatus further includes a drainage hose extended outward from and in fluid communication with the inner chamber of the snow removal collection tank. The drainage hose has a release valve and a distal end removably disposed within a sewer drain. A snow intake hose is also extended outward from and in fluid communication with the inner chamber of the snow removal collection tank.

The vacuum unit is configured to pull snow into the inner chamber of the snow removal collection tank through the snow intake hose, and the heating unit is configured to melt the snow disposed within the snow removal collection tank while air circulates from the intake vent of the heating unit through the inner chamber of the snow removal collection tank and out the exhaust vent of the vacuum unit. Lastly, the drainage hose is configured to release melted snow from within the inner chamber of the snow removal collection tank when the release valve of the drainage hose is open. The mobile snow removal and collection apparatus thus eliminates the need for a user to laboriously shovel snow from a sidewalk, driveway, and roadway, while also eliminating the need to pile snow and block useable space within each of those areas.

Thus has been broadly outlined the more important features of the present mobile snow removal and collection apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
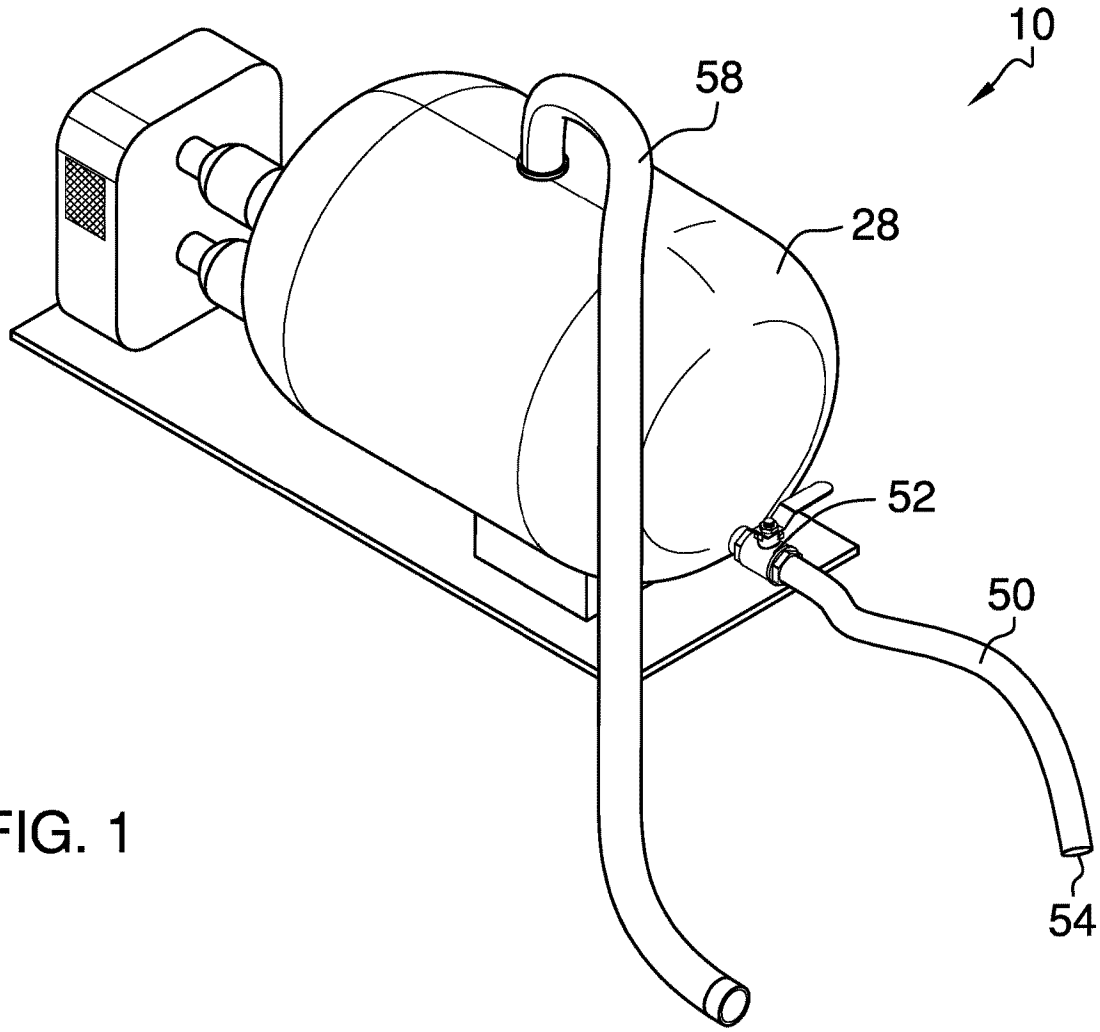
FIG. 1 is a front isometric view.
Figure 2:
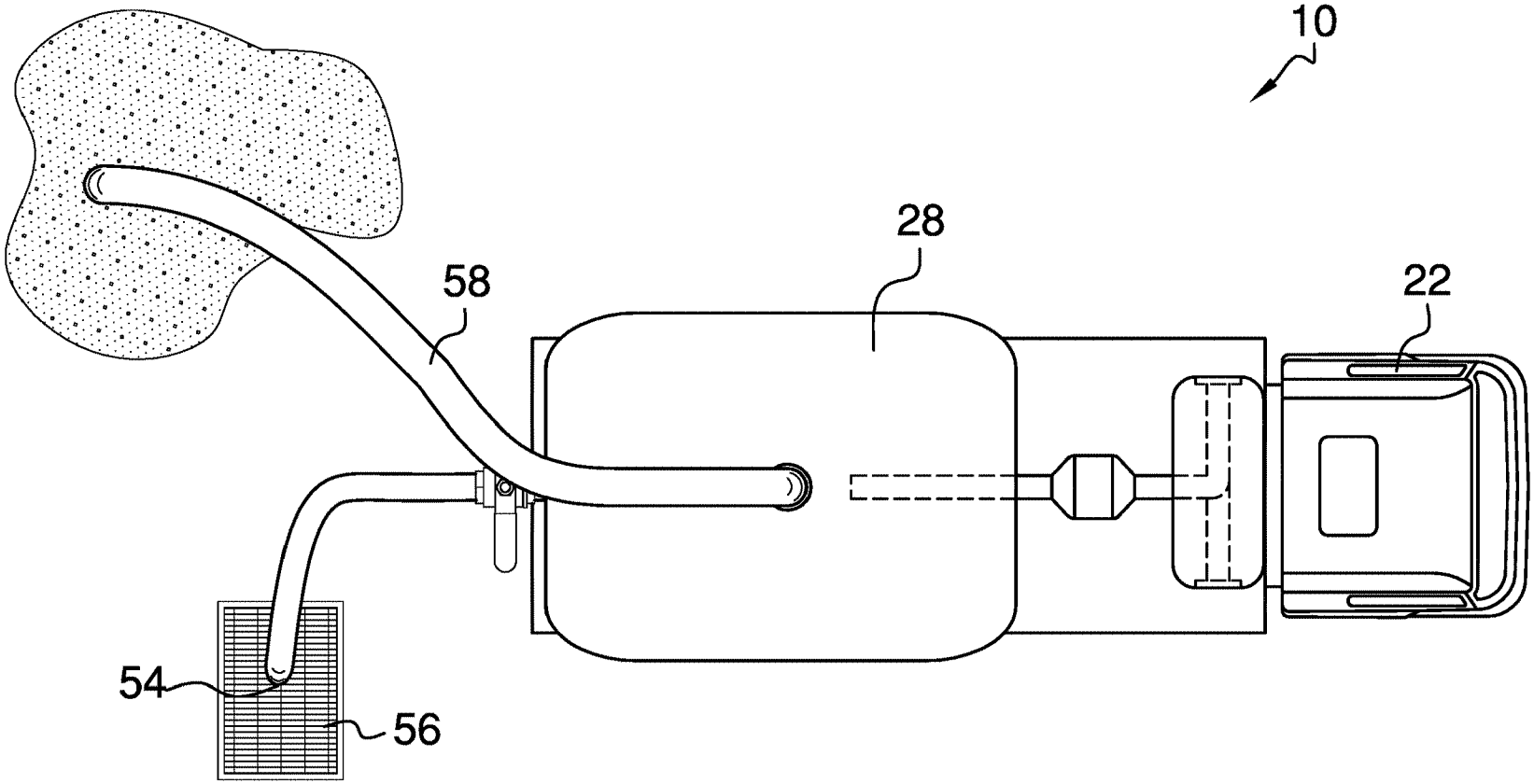
FIG. 2 is a top plan view.
Figure 3:
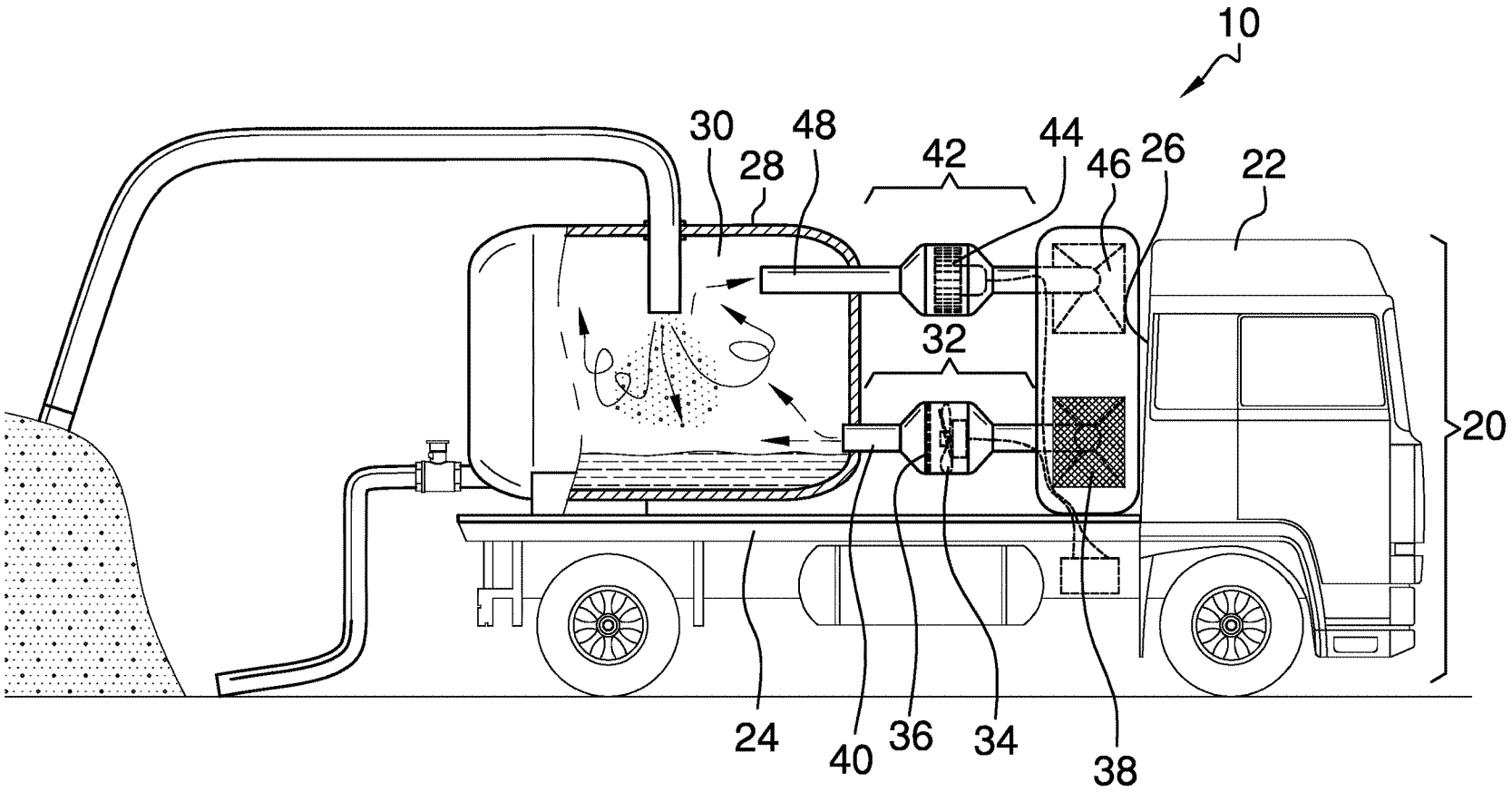
FIG. 3 is a side elevation view.
Figure 4:
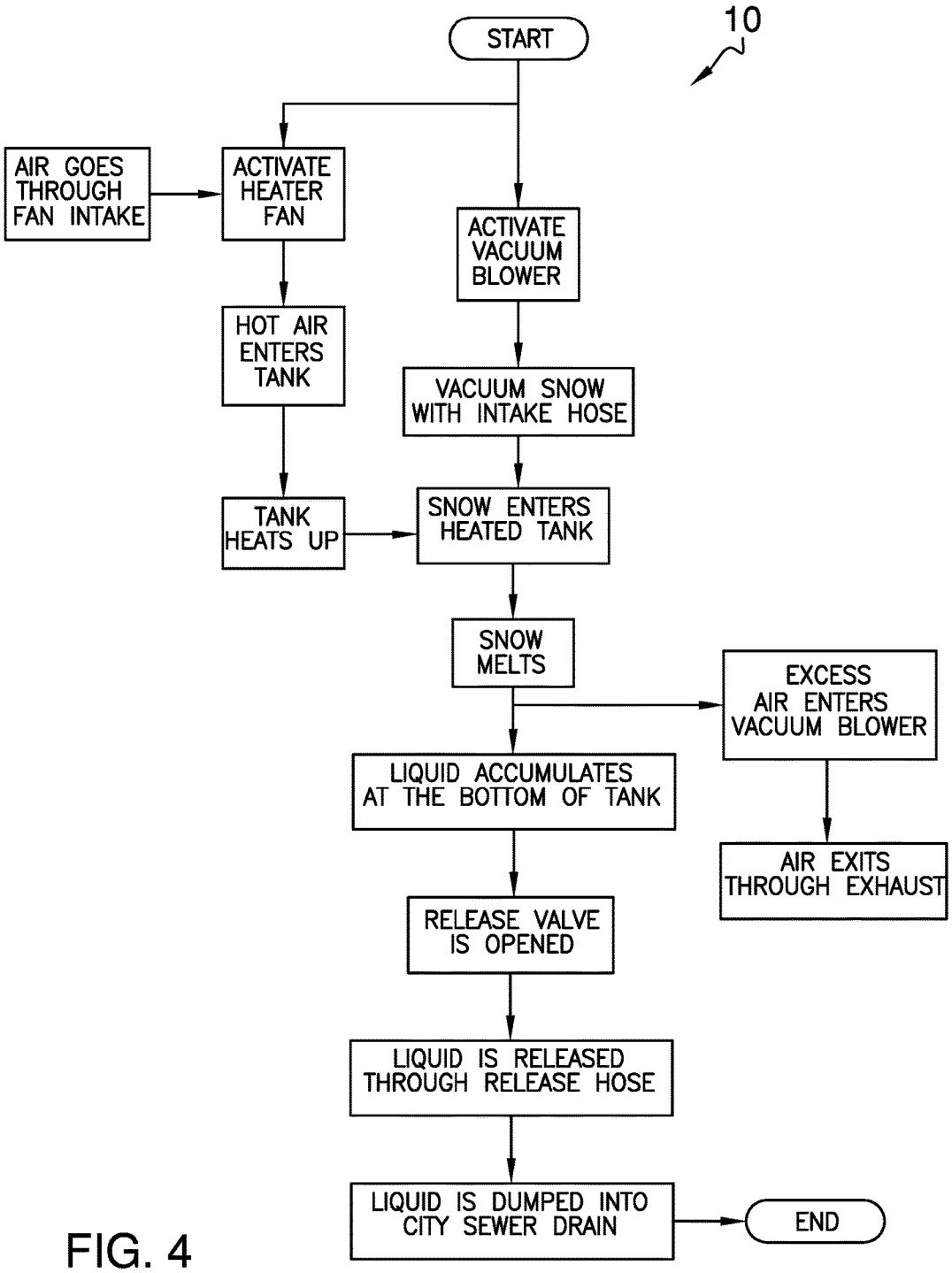
FIG. 4 is a block diagram.

With reference now to the drawings, and in particular FIGS. 1 through 4 thereof, an example of the instant mobile snow removal and collection apparatus employing the principles and concepts of the present mobile snow removal and collection apparatus and generally designated by the reference number 10 will be described.

Referring to FIGS. 1 through 4 the present mobile snow removal and collection apparatus 10 is illustrated. The mobile snow removal and collection apparatus 10 includes a wheeled motorized vehicle 20 having a front cab 22 and a vehicle chassis 24 attached to a back end 26 of the front cab 22. A snow removal collection tank 28 is disposed immediately atop the vehicle chassis 24 of the wheeled motorized vehicle 20, with the snow removal collection tank 28 having an inner chamber 30. A heating unit 32 is disposed atop the vehicle chassis 24 between the back end 26 of the front cab 22 of the wheeled motorized vehicle 20 and the snow removal collection tank 28. The heating unit 32 has a motorized fan 34, at least one heating element 36, an intake vent 38 in fluid communication with the motorized fan 34, and a heating nozzle 40 in fluid communication with each of the motorized fan 34 and the inner chamber 30 of the snow removal collection tank 28. A vacuum unit 42 is disposed atop the heating unit 32 and between the back end 26 of the front cab 22 of the wheeled motorized vehicle 20 and the snow removal collection tank 28. The vacuum unit 42 has a motorized blower 44, an exhaust vent 46 in fluid communication with the motorized blower 44, and a vacuum nozzle

48 in fluid communication with each of the motorized blower 44 and the inner chamber 30 of the snow removal collection tank 28.

The mobile snow removal and collection apparatus 10 further includes a drainage hose 50 extended outward from and in fluid communication with the inner chamber 30 of the snow removal collection tank 28. The drainage hose 50 has a release valve 52 and a distal end 54 removably disposed within a sewer drain 56. A snow intake hose 58 is also extended outward from and in fluid communication with the inner chamber 30 of the snow removal collection tank 28.

What is claimed is:

1. A mobile snow removal and collection apparatus comprising:

a wheeled motorized vehicle having a front cab and a vehicle chassis attached to a back end of the front cab;

a snow removal collection tank disposed immediately atop the vehicle chassis of the wheeled motorized vehicle, the snow removal collection tank having an inner chamber;

a heating unit disposed atop the vehicle chassis offset from the snow removal collection tank such that the heating unit is positioned to extend substantially between the back end of the front cab of the wheeled motorized vehicle and the snow removal collection tank, the heating unit having a motorized fan and at least one heating element, said heating element being positioned laterally offset from said snow removal collection tank, said heating unit further having an intake vent in fluid communication with the motorized fan, and a heating nozzle in fluid communication with each of the motorized fan and the inner chamber of the snow removal collection tank;

a vacuum unit disposed atop the heating unit and between the back end of the front cab of the wheeled motorized vehicle and the snow removal collection tank, the vacuum unit having a motorized blower, an exhaust vent in fluid communication with the motorized blower, and a vacuum nozzle in fluid communication with each of the motorized blower and the inner chamber of the snow removal collection tank;

a drainage hose extended outward from and in fluid communication with the inner chamber of the snow removal collection tank, the drainage hose having a release valve, wherein a distal end of the drainage hose is removably disposed within a sewer drain; and a snow intake hose extended outward from and in fluid communication with the inner chamber of the snow removal collection tank;

wherein the vacuum unit is configured to pull snow into the inner chamber of the snow removal collection tank through the snow intake hose; wherein the heating unit is configured to melt the snow disposed within the snow removal collection tank while air circulates from the intake vent of the heating unit through the inner chamber of the snow removal collection tank and out the exhaust vent of the vacuum unit; wherein the drainage hose is configured to release melted snow from within the inner chamber of the snow removal collection tank when the release valve of the drainage hose is open.

* * * * *